US008007304B2

(12) United States Patent
Cheng

(10) Patent No.: US 8,007,304 B2
(45) Date of Patent: Aug. 30, 2011

(54) CONTACT STRIP HAVING PRE-BREAK RECESS WITH GRADIENT WIDTH AND DEEP

(75) Inventor: Chih-Pi Cheng, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/854,179

(22) Filed: Aug. 11, 2010

(65) Prior Publication Data

US 2011/0039452 A1 Feb. 17, 2011

(30) Foreign Application Priority Data

Aug. 11, 2009 (TW) ..... 98214741 U

(51) Int. Cl.
*H01R 13/625* (2006.01)

(52) U.S. Cl. ..... 439/342; 439/885

(58) Field of Classification Search ..... 439/342, 439/857, 357, 83, 70, 885
See application file for complete search history.

(56) References Cited

U.S. PATENT DOCUMENTS 4,269,468 A * 5/1981 Ammon et al. ..... 439/637
4,288,141 A * 9/1981 Leather ..... 439/395
6,231,406 B1 * 5/2001 Lin et al. ..... 439/885
6,406,338 B1 * 6/2002 Endo et al. ..... 439/885
6,620,002 B1 * 9/2003 Billman et al. ..... 439/885
7,402,066 B2 * 7/2008 Liao ..... 439/342
2008/0227324 A1 * 9/2008 Cheng et al. ..... 439/342
2009/0088016 A1 * 4/2009 Liao ..... 439/357
2009/0311889 A1 * 12/2009 Chien et al. ..... 439/80

FOREIGN PATENT DOCUMENTS

CN 201075434 6/2008

* cited by examiner

*Primary Examiner* — T C Patel
*Assistant Examiner* — Phuongchi T Nguyen
(74) *Attorney, Agent, or Firm* — Andrew C. Cheng; Wei Te Chung; Ming Chieh Chang

(57) ABSTRACT

A contact strip comprises a plurality of contacts, and a connecting carrier having a plurality of connecting portions connecting with the contacts. The contact has a main body, a linking portion extending upwardly from the main body and a mounting portion downwardly bent from the main body. A pair of pre-break recesses are symmetrically defined on a front and a rear surfaces of the connecting portion, the recess laterally extends through the whole connecting portion and substantially has a gradual deeper depth. Operator can quickly and conveniently tear the recesses from the deep side of the recess to the shallow side of the recess to remove the connecting carrier from the contacts.

10 Claims, 6 Drawing Sheets

CONTACT STRIP HAVING PRE-BREAK RECESS WITH GRADIENT WIDTH AND DEEP

FIELD OF THE INVENTION

The present invention relates to a contact strip, and more particularly to a contact strip with a plurality of contact terminals connected to a carrier, and in which a pre-break recess with gradient width from edge to edge is defined at each contact terminal in an area adjacent to the carrier.

DESCRIPTION OF RELATED ART

As a result of reaching to small and compact trend, electronic devices have become more and more smaller which leads to a fine pitch connector and other electrical components. Chinese Utility Patent No. 201075434, issued to Zhu., on Jun. 18, 2008, discloses a contact strip including a connecting carrier and a plurality of contacts disposed below the connecting carrier. The contact has a base, a head portion upwardly extending from a middle part of the base, a soldering portion downwardly bent from the base to be soldered on a printed circuit board and a plurality of barbs outwardly protruding from two opposed sides of the base. The connecting carrier is provided with a plurality of legs connecting with the head portions of the contacts and defining a pre-break surface.

However, there is some disadvantages with above contact strip, after the contacts are assembled into an insulative housing, the connecting carrier is firstly angularly bent at the pre-break surface, then bent to an original position, and this action is continuously repeated till the connecting carrier leaves the contacts, so this method of removing the connecting carrier is complex, and the contacts of the contact strip or the contacts of an adjacent contact strip may be broken during this removing process.

Hence, an improved contact strip is required to overcome the above-mentioned disadvantages of the related art.

SUMMARY OF THE INVENTION

An object of the present invention is to provide a contact strip, which has an unsymmetrical pre-break recess for being torn.

To achieve the aforementioned object, a contact strip comprises a plurality of contacts and a connecting carrier. The contact has a main body, a linking portion extending from the main body and a mounting portion downwardly bent from the main body. The connecting carrier has a plurality of connecting portions connecting with the contacts, and at least one recess extends through two opposite lateral sides of the connecting portion and gradually becomes deeper from one of the lateral side to the other lateral side so as to be easily torn from the other lateral side of the connecting portion to remove the connecting carrier from the contacts.

Other objects, advantages and novel features of the invention will become more apparent from the following detailed description of a preferred embodiment when taken in conjunction with the accompanying drawings.

DETAILED DESCRIPTION OF THE INVENTION

Figure 1:
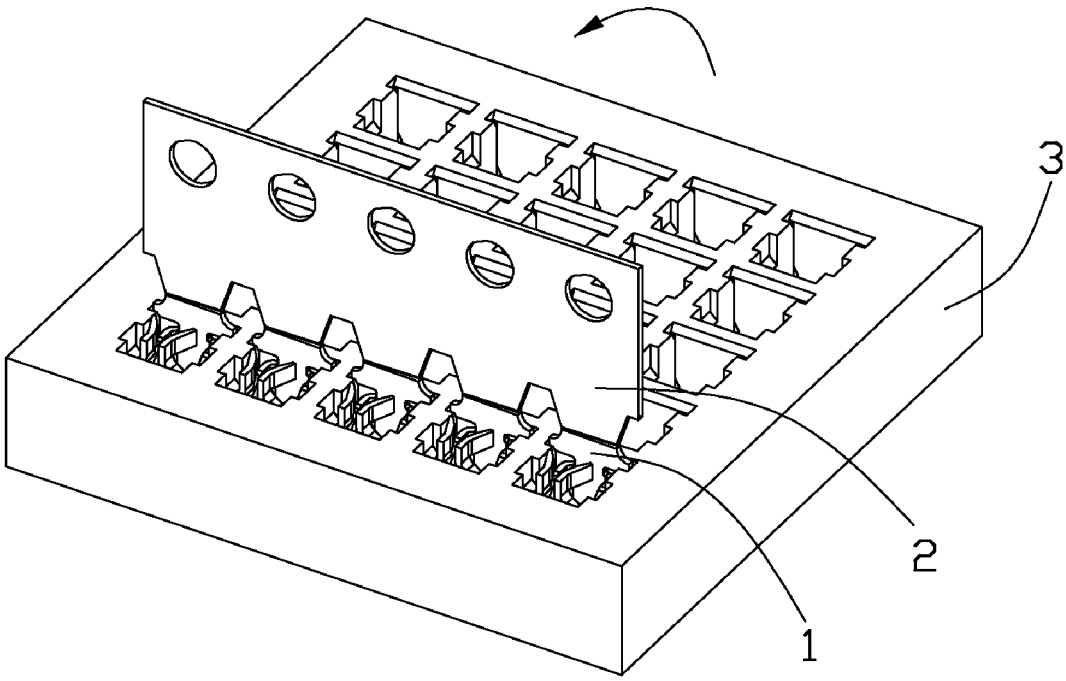
FIG. 1 is a perspective view of a contact strip in accordance with a preferred embodiment of present invention, showing the contact strip assembled to an insulative housing.
Figure 2:
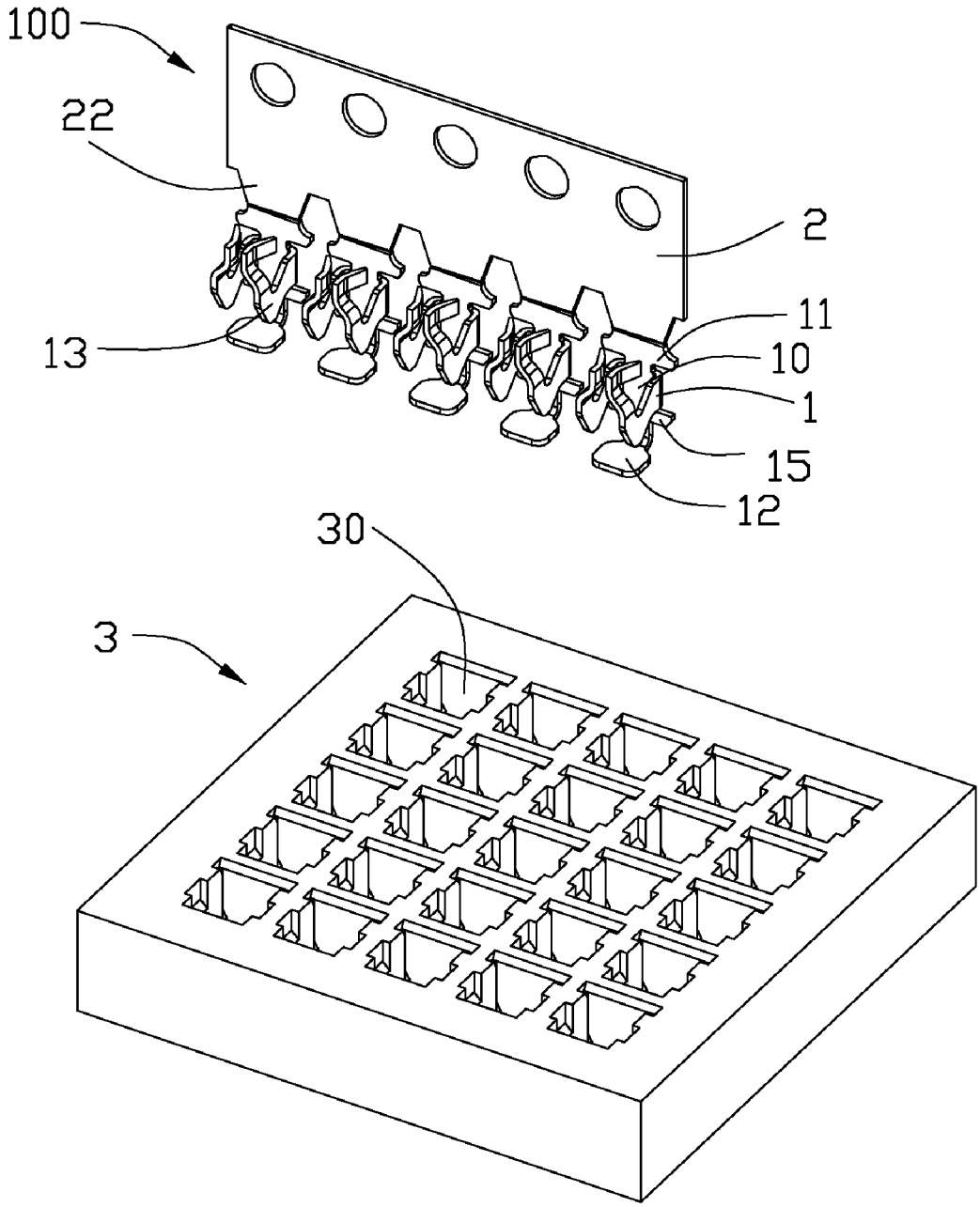
FIG. 2 is another perspective view of the contact strip and the insulative housing.
Figure 3:
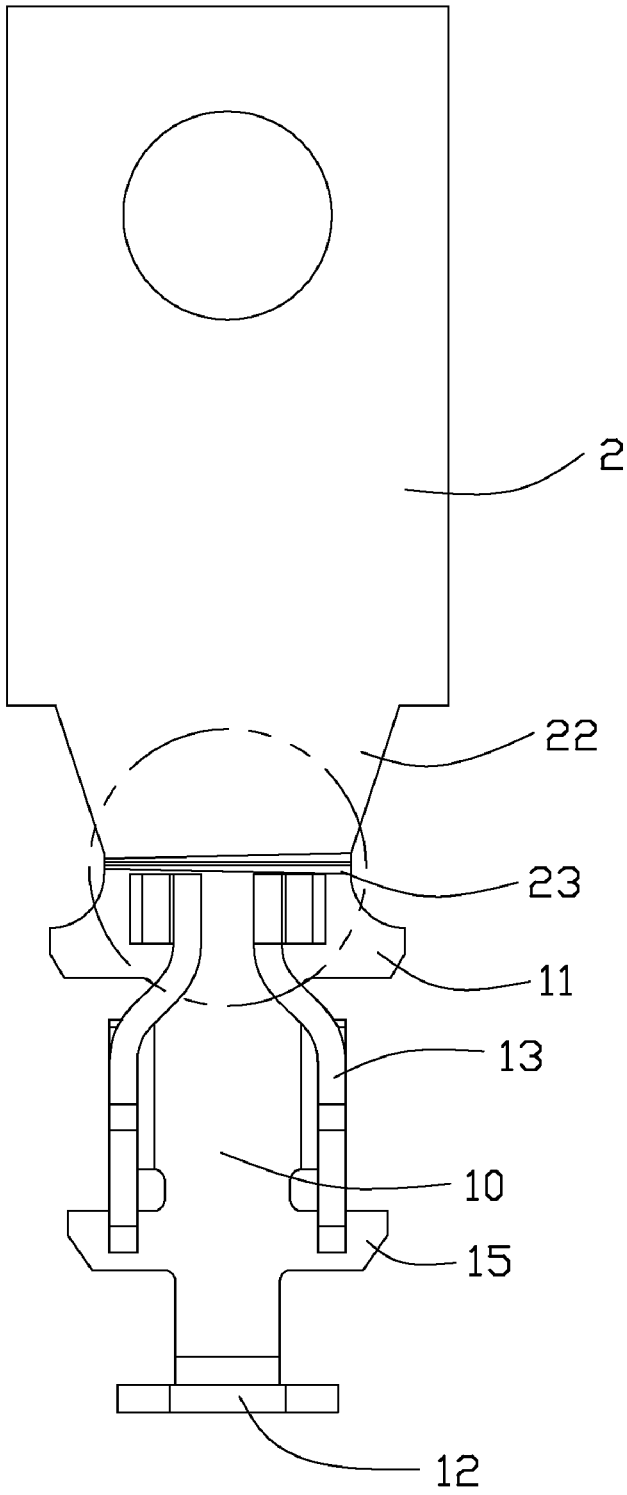
FIG. 3 is a part of the contact strip, showing a single contact of the contact strip.
Figure 4:
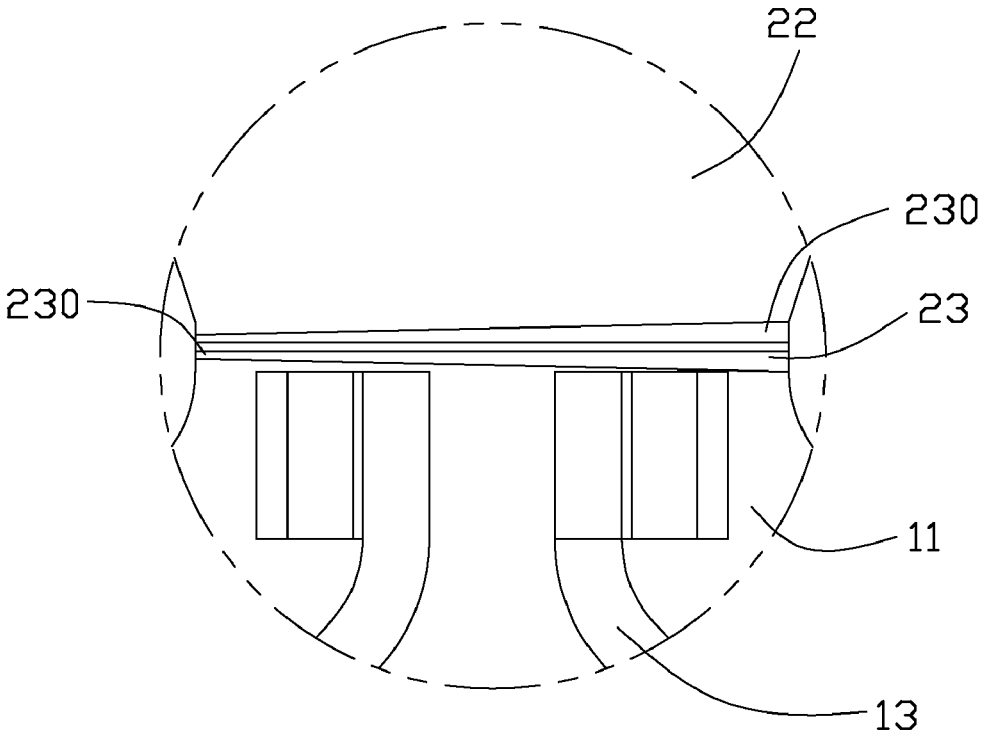
FIG. 4 is an enlarged view of the circled part in FIG. 3.
Figure 5:
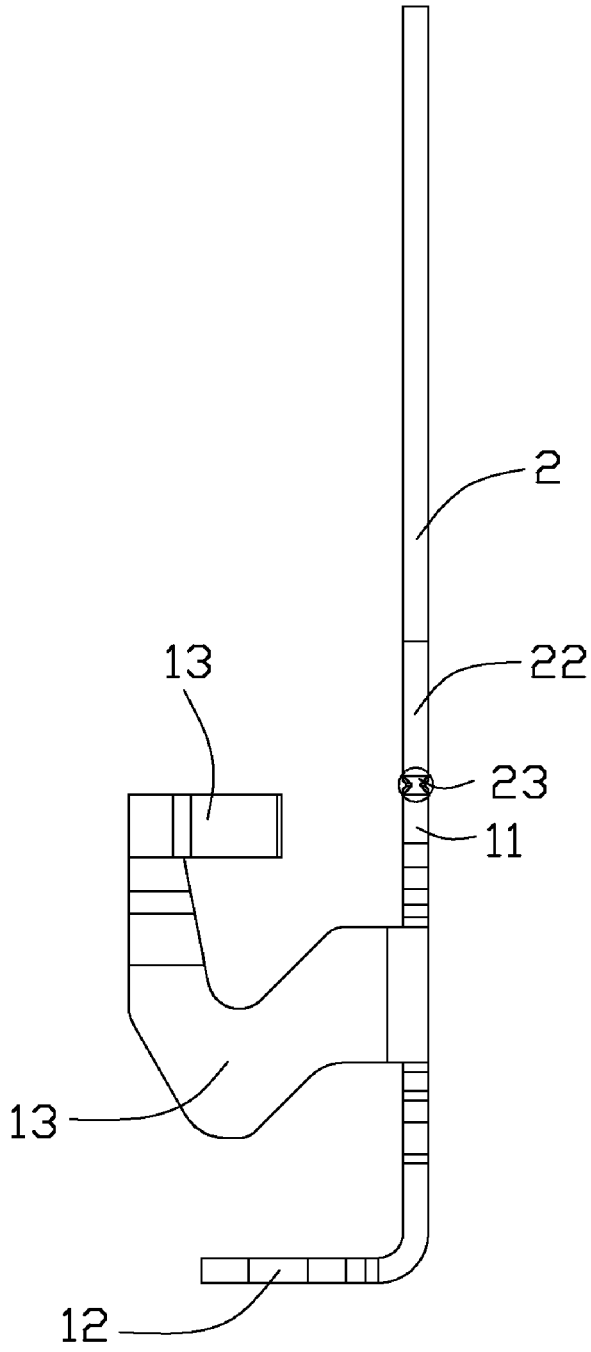
FIG. 5 is a side view of the part of the contact strip in FIG. 3.
Figure 6:
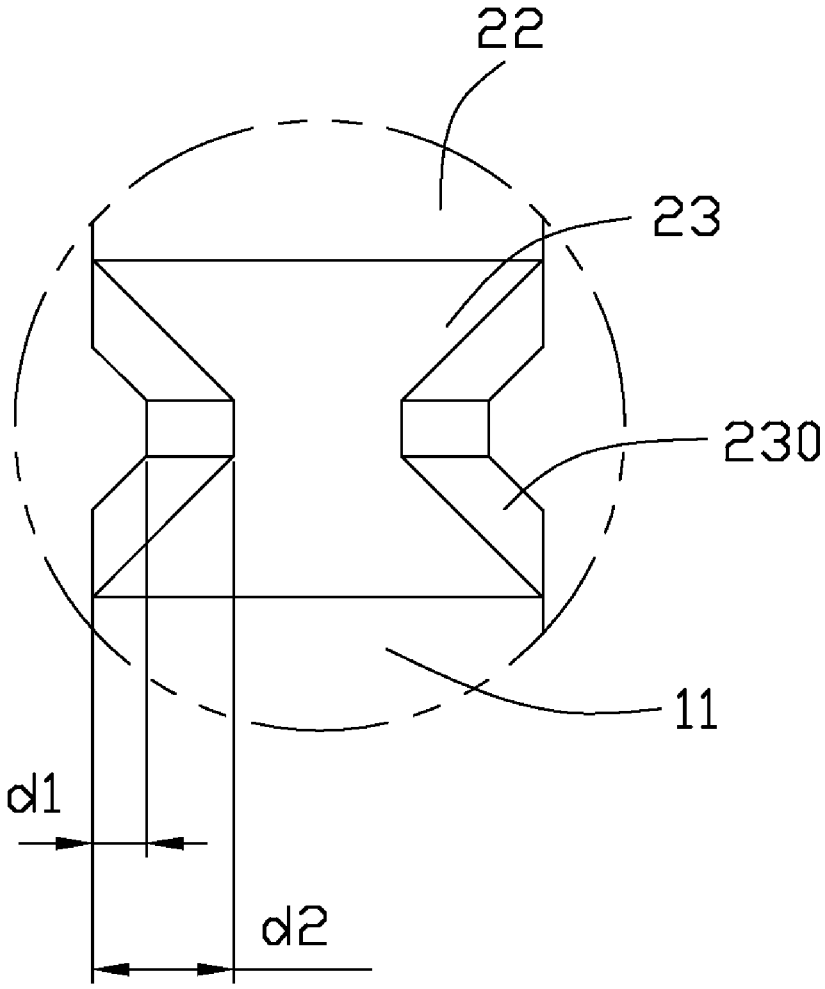
FIG. 6 is an enlarged view of the circled part in FIG. 5.

Referring to FIGS. 1 and 2, the contact strip in accordance with a preferred embodiment of present invention is disclosed, the contact strip is stamped from a metal piece and comprises a narrow connecting carrier 2 and a plurality of contacts 1 positioned below and connecting with the connecting carrier 2. In assembling, these contacts 1 are shoveled into corresponding contact receiving holes 30 with the help of the connecting carrier 2.

The contact 1 is used to electrically connect the IC (integrated circuit) package (not shown) to a printed circuit board (not shown). The contact 1 has a blade-like main body 10, a linking portion 11 upwardly extending from the main body 10, a mounting portion 12 bent and extending from a bottom edge of the main body 10 and a pair of contacting arms 13 bent from two opposite lateral sides of an upper part of the main body 10, respectively, and extending to face each other. Two retaining portions 15 outwardly protrude from two opposite lateral sides of a lower part of the main body 10, respectively.

Referring to FIGS. 3-6, a plurality of connecting portions 22 downwardly extend from the connecting carrier 2 and connect the connecting carrier 2 with the contacts 1. Two pre-break recesses 23 are symmetrically defined and extend along a front surface and a rear surface of the connecting portion 22, respectively, the recess 23 horizontally extends through two opposite lateral sides of the connecting portion 22 and define two gaps 230 in the two opposite lateral sides of the connecting portion 22.

FIGS. 3-6 shows the recess 23 of the connecting portion 22 in different views, from these drawings, the recess 23 shown is asymmetrically designed, the dimension of the recess 23 gradually becomes deeper and wider along a left-to-right direction, in another word, the recess 23 substantially has a pyramidal shape along an extending direction thereof. The two gaps 230 in the right and the left sides of the connecting portion 22 have different sizes, the left gap 230 of the recess 230 is narrow and shallow with a depth d1, and the right gap 230 of the recess 23 is wide and deep with a depth d2, the connection portion 22 can be easily and readily broken away starting from the right side gap 230. Operator can conveniently tear the connecting carrier 2 along the right-to-left direction to remove the connecting carrier 2 from the contacts 1. The left shallow part of the recess 23 ensures that the connecting portion 22 connects with the contact 1 before being torn.

In assembly, the contacts 1 are firstly shoveled into the housing 3 by the help of the connecting carrier 2, then the connecting carrier 2 is removed by breaking it along the pre-break recesses 23, that means beginning from the right gap 230 with wider and deeper dimension, so the connecting portions 22 are directly torn from the linking portions 11 of the contacts 1 so as to remove the connecting carrier 2 from the contacts 1. By tearing the unsymmetrical recess 23 from right to left, operator can quickly and conveniently tear the connecting carrier 2 from the contacts 1 and will not hurt the contacts 1 of the contact strip or adjacent contacts (not shown) received in an adjacent row of contact receiving holes 30.

However, the disclosure is illustrative only, changes may be made in detail, especially in matter of shape, size, and arrangement of parts within the principles of the invention.

What is claimed is:

1. A contact strip comprises:

a plurality of contacts, the contact having a main body, a linking portion extending from the main body and a mounting portion downwardly bent from the main body; and a connecting carrier having a plurality of connecting portions connecting with the contacts, at least one recess extending through two opposite lateral sides of the connecting portion and gradually becoming deeper from one of the lateral side to the other lateral side so as to be easily torn from the other lateral side of the connecting portion to remove the connecting carrier from the contacts.

2. The contact strip as claimed in claim 1, wherein the recess is symmetrically defined on both a front surface and a rear surface of the connecting portion.

3. The contact strip as claimed in claim 2, wherein the recess substantially has a pyramidal shape along an extending direction thereof, and a dimension of the recess gradually becomes deeper and wider.

4. The contact strip as claimed in claim 3, wherein the recess horizontally defines two gaps in the two lateral sides of the connecting portion, and the two gaps have different sizes, the gap on the other lateral side has a bigger dimension.

5. The contact strip as claimed in claim 3, wherein the contact further comprises a pair of contacting arms bent from two opposite lateral sides of an upper part of the main body, respectively.

6. The contact strip as claimed in claim 5, wherein the contact further comprises two retaining portions outwardly protruding from two opposite sides of a lower part of the main body, respectively.

7. A carrier strip comprising:

a carrier having an edge; and at least one contact extending from said edge of the strip and comprising:

a connecting portion extending from said edge and having first and second edges;

an engaging portion extending from the connecting portion; and a recess arranged at the connecting portion adjacent to the edge of the carrier and which has a gradient width and depth from first edge to the second edge.

8. An electrical connector comprising:

an insulative housing defining a plurality of passageways in matrix and arranged with rows and columns; and a plurality of contacts respectively disposed in the corresponding passageways, each of said contacts defining a connection portion with a torn edge which originally is used to be connected to a carrier with other contacts of a same row in a side-by-side manner before assembled into the corresponding passageways; wherein said torn edge defines an asymmetric boundary area between thereof a first end to a second end microscopically under condition that the boundary area around the first end is larger than that around the second end for allowing said contact to be torn away from the carrier from the first end to the second end.

9. The electrical connector as claimed in claim 8, wherein said asymmetric boundary defines a divergently gradient configuration, from the second end toward the first end, at least along one of a thickness direction of said connection portion, which is essentially perpendicular to said edge, and a transverse direction with regard to the edge, which is essentially perpendicular to both side edge and said thickness direction.

10. The electrical connector as claimed in claim 9, wherein a tip of said torn edge keeps horizontal with regard to the corresponding passageway.

* * * * *